US007972223B2

(12) United States Patent
Lee

(10) Patent No.: US 7,972,223 B2
(45) Date of Patent: Jul. 5, 2011

(54) GOLF CLUB

(75) Inventor: Jae Woong Lee, Gimpo-si (KR)

(73) Assignee: Delta Industry Co., Ltd., Gimpo-si, Gyeonggi-do (KR)

( * ) Notice: Subject to any disclaimer, the term of this patent is extended or adjusted under 35 U.S.C. 154(b) by 112 days.

(21) Appl. No.: 12/388,657

(22) Filed: Feb. 19, 2009

(65) Prior Publication Data

US 2009/0209360 A1 Aug. 20, 2009

(30) Foreign Application Priority Data

Feb. 19, 2008 (KR) ..... 10-2008-0014969

(51) Int. Cl.
*A63B 53/10* (2006.01)

(52) U.S. Cl. ..... 473/319; 473/323

(58) Field of Classification Search ..... 473/316–323
See application file for complete search history.

(56) References Cited

U.S. PATENT DOCUMENTS 4,319,750 A * 3/1982 Roy ..... 473/320
4,555,112 A 11/1985 Masghati
5,035,764 A * 7/1991 Blake ..... 156/327
5,692,971 A 12/1997 Williams
2003/0114241 A1* 6/2003 Oldenburg ..... 473/323
2003/0125125 A1* 7/2003 Oyama ..... 473/323

FOREIGN PATENT DOCUMENTS

JP 07-308411 11/1995
JP 2001-224719 8/2001
KR 10-393731 4/2001

* cited by examiner

*Primary Examiner* — Stephen L. Blau
(74) *Attorney, Agent, or Firm* — Kile Park Goekjian Reed & McManus PLLC

(57) ABSTRACT

A graphite golf club which is formed on a mandrel is provided. The graphite golf club comprises a club head which strikes a golf ball; a club shaft which comprises a coupling unit to be coupled with the club head and a main body unit extending from the coupling unit to a golf club grip. The mandrel includes a mandrel joint unit which is formed with mandrel steps that decrease in diameter from one end of the mandrel to the other end of the mandrel. The golf club shaft is formed on the mandrel with a lower sheet layer contacting and overlapping the mandrel and an upper sheet layer overlapping an outer part of the lower sheet layer. The lower sheet layer and the upper sheet layer form a sheet joint unit which includes sheet steps decreasing in diameter corresponding to the mandrel steps.

3 Claims, 5 Drawing Sheets

GOLF CLUB

CROSS-REFERENCE TO RELATED APPLICATION

This application claims priority from Korean Patent Application No. 10-2008-0014969, filed on Feb. 19, 2008, in the Korean Intellectual Property Office, the disclosure of which is incorporated herein by reference.

BACKGROUND OF THE INVENTION

1. Field of the Invention

The present invention relates to a golf club, and more particularly, to a golf club wherein the golf club shaft has an improved configuration.

2. Description of the Related Art

When a player strikes a golf ball with a golf club, a club shaft of the golf club receives a load or shock due to impact of a club head and the golf ball. Here, various stresses are applied to the club shaft. What influences most to the characteristics of the club shaft among those stresses is bending stress which is generated by the striking point of the club head and the grip point of the club shaft spaced as much as the length of the club shaft, and torsional stress which is generated by the striking point of the club head and a club shaft connector spaced from each other. Further, the shock which is generated at a moment the golf club strikes the golf ball is preferably not transmitted to a user but absorbed by the club shaft.

If the strength of the club shaft is too low, the club shaft is excessively deformed when striking the golf ball and cannot strike the golf ball accurately. If the elasticity of the club shaft is low or the strength of the club shaft is too high, excess shock is transmitted to the human body. Thus, it is preferable that the club shaft has proper strength and elasticity.

In consideration of the foregoing matters, club shafts which are most widely used include a metal club shaft which includes metal alloys such as steel alloys, aluminum alloys, etc. and a graphite club shaft which includes fibers that are reinforced by epoxy resin and so on.

Among them, the metal club shaft has been first to be commercial and still widely used with continued improvement. The strength of the metal club shaft with respect to load is isotropic and represents uniform strength against tensile load or compressive load and shearing load. Accordingly, the metal club shaft is easily designed and manufactured without having to consider directions at the time of manufacture and has uniform and strong properties against bending stress and torsional stress. However, the metal club shaft has more specific gravity than the graphite club shaft but less tensile strength than the graphite club shaft. The metal club shaft has such an issue that it has less strength to weight than the graphite club shaft.

Meanwhile, the graphite club shaft is weak to a load in a direction opposite to the direction of fibers, and the design and manufacturing process of the graphite club shaft are complicated. However, the graphite club shaft may be manufactured to have proper strength according to the direction and laminating method of the fibers and has a far lower specific gravity than the metal club shaft. Thus, the graphite club shaft generally has better durability against weight than the metal club shaft. The graphite club shaft has a laminating configuration and thus has less torsional strength than the metal club shaft. The graphite club shaft is cured by epoxy resin and has stronger brittleness than the metal club shaft. Thus, the graphite club shaft is easily cracked or broken by external shock.

Accordingly, it would be preferable to provide a graphite club shaft that absorbs shock arising out of the striking of a golf ball, stabilizes swing speed and improves flight distance of the golf ball.

SUMMARY OF THE INVENTION

Accordingly, it is an aspect of the present invention to provide a golf club which stabilizes a swing speed and improves striking feel.

Also, it is another aspect of the present invention to provide a golf club which secures stable and improved fight distance.

Further, it is another aspect of the present invention to provide a golf club which excels in absorbing shock.

Further, it is another aspect of the present invention to provide a golf club whose quality is uniform.

Additional aspects and/or advantages of the present invention will be set forth in part in the description which follows and, in part, will be obvious from the description, or may be learned by practice of the present invention.

The foregoing and/or other aspects of the present invention are also achieved by providing a graphite golf club which is formed by a mandrel, the graphite golf club comprising a club head which strikes a golf ball; a club shaft which comprises a coupling unit to be coupled with the club head and a main body unit extending from the coupling unit the mandrel comprising a mandrel joint unit which is formed with mandrel steps that drastically decrease in diameter the coupling unit and the main body unit comprising a lower sheet layer contacting and overlapping the mandrel and an upper sheet layer overlapping an upper part of the lower sheet layer; the lower sheet layer and the upper sheet layer forming a sheet joint unit which comprises sheet steps drastically decreasing in diameter corresponding to the mandrel steps one of the lower and upper sheet layers being cut between the sheet joint unit and overlapping and surrounding on the mandrel a direction of fibers of one of the lower and upper sheet layers divided and cut by the sheet joint unit being different from a direction of fibers of neighboring lower and upper sheet layers; and a joint unit which is formed with steps drastically decreasing in external diameter corresponding to the sheet steps.

According to another aspect of the present invention, the graphite golf club further comprises a taping layer which is taped with a tape from an external part of the upper sheet layer, wherein the tape is taped to an upper part of the upper sheet layer with a tension of 3.5 kg/cm$^2$ to 5.5 kg/cm$^2$.

According to another aspect of the present invention, the number of plies of one of the lower and upper sheet layers divided and cut by the sheet joint unit is different from the number of plies of neighboring lower and upper sheet layers.

According to another aspect of the present invention, one of the lower sheet layers is formed with three plies overlapping so that a direction of fibers sequentially crosses at 45 degrees, and the other one of the lower sheet layers has fibers whose direction is 90 degrees and has a single layer.

According to another aspect of the present invention, an external diameter is ground by a center-less grinder.

BRIEF DESCRIPTION OF THE DRAWINGS

The above and/or other aspects of the present invention will become apparent and more readily appreciated from the following description of the embodiments, taken in conjunction with the accompanying drawings of which.

DETAILED DESCRIPTION OF EXEMPLARY EMBODIMENT

Hereinafter, exemplary embodiments of the present invention will be described with reference to accompanying drawings, wherein like numerals refer to like elements and repetitive descriptions will be avoided as necessary.

Hereinafter, a golf club according to the present invention will be described with reference to accompanying drawings.

Here, a golf club may refer to a single golf club including a club shaft and a club head or a golf club set including a couple of golf clubs. For example, the golf club according to the present invention may refer to only a driver, or an iron set, or a driver, an iron and a putter included in the golf club full set. Hereinafter, it is assumed that the golf club is a single golf club for purposes of convenience.

First Exemplary Embodiment

Figure 1:
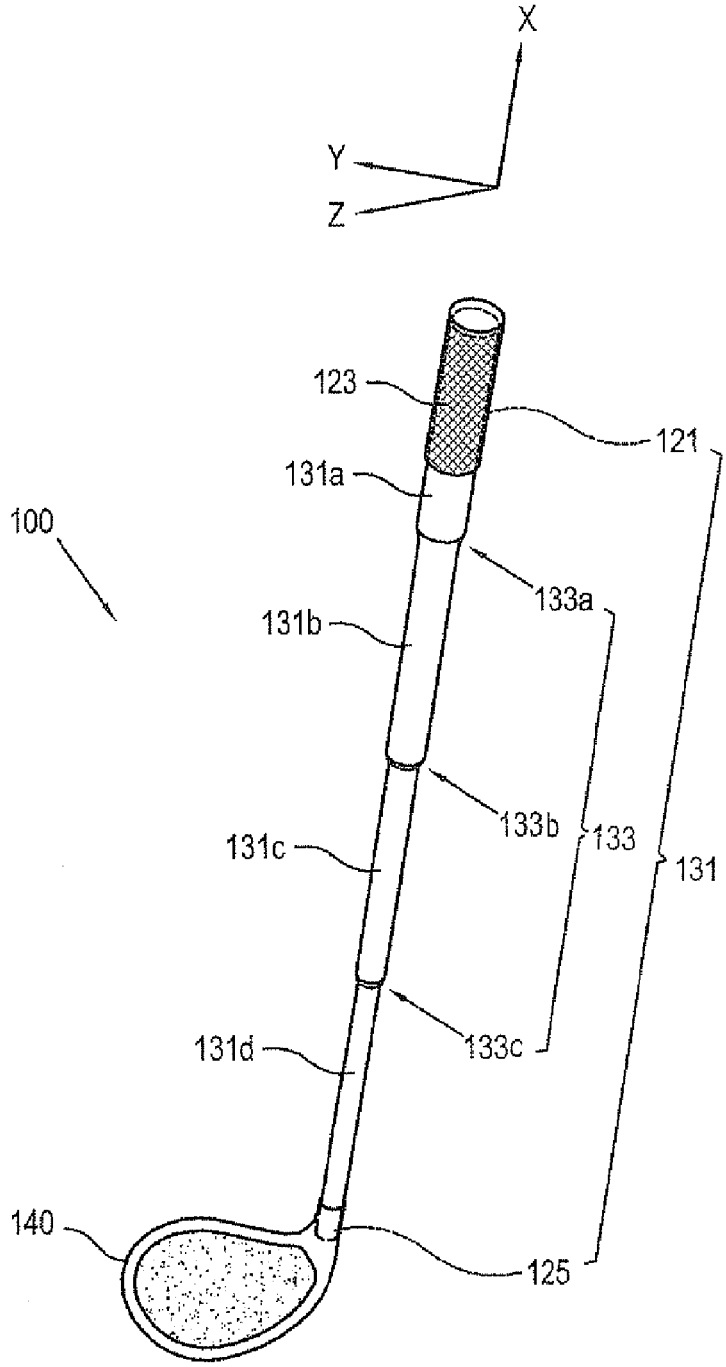
FIG. 1 is a perspective view of a golf club according to an exemplary embodiment of the present invention.
Figure 2:
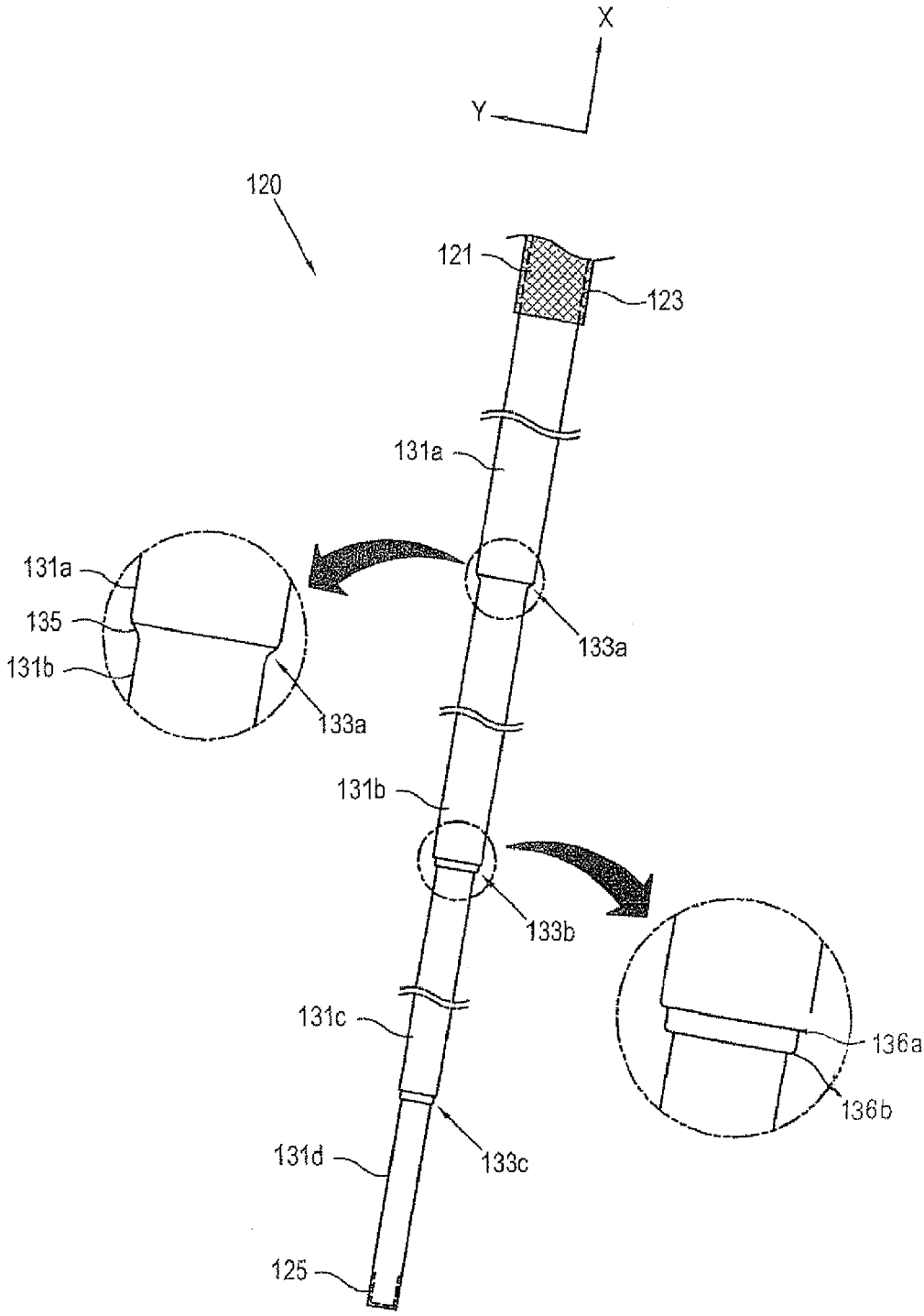
FIG. 2 is a partial enlarged view of a main body unit in FIG. 1.

As shown in FIGS. 1 and 2, a golf club 100 according to the present invention includes a club head 140, and a club shaft 120 having a main body unit 131 which is formed with joint units 133*a-c*.

Hereinafter, for purposes of convenience, an axial direction of the club shaft 120 is called a direction "X", upper and lower direction which is perpendicular to the direction X is called a direction "Y" and front and rear directions which is perpendicular to a "X-Y" plane is called a direction "Z".

The club head 140 is coupled to a lower end of the club shaft 120 and includes a striking surface to strike a golf ball. The club head 140 includes various types of alloys or wood. The club head 140 is firmly coupled with a coupling unit 125 of the club shaft 120 by an adhesive and so on.

The club shaft 120 includes a grip unit 121, the coupling unit 125, the main body unit 131 and the joint units 133*a-c*.

The club shaft 120 may be roughly categorized into a metal club shaft and a graphite club shaft. Here, graphite includes known materials such as carbon fibers or various reinforcement films. The club shaft 120 according to the present invention preferably includes graphite.

Figure 3:
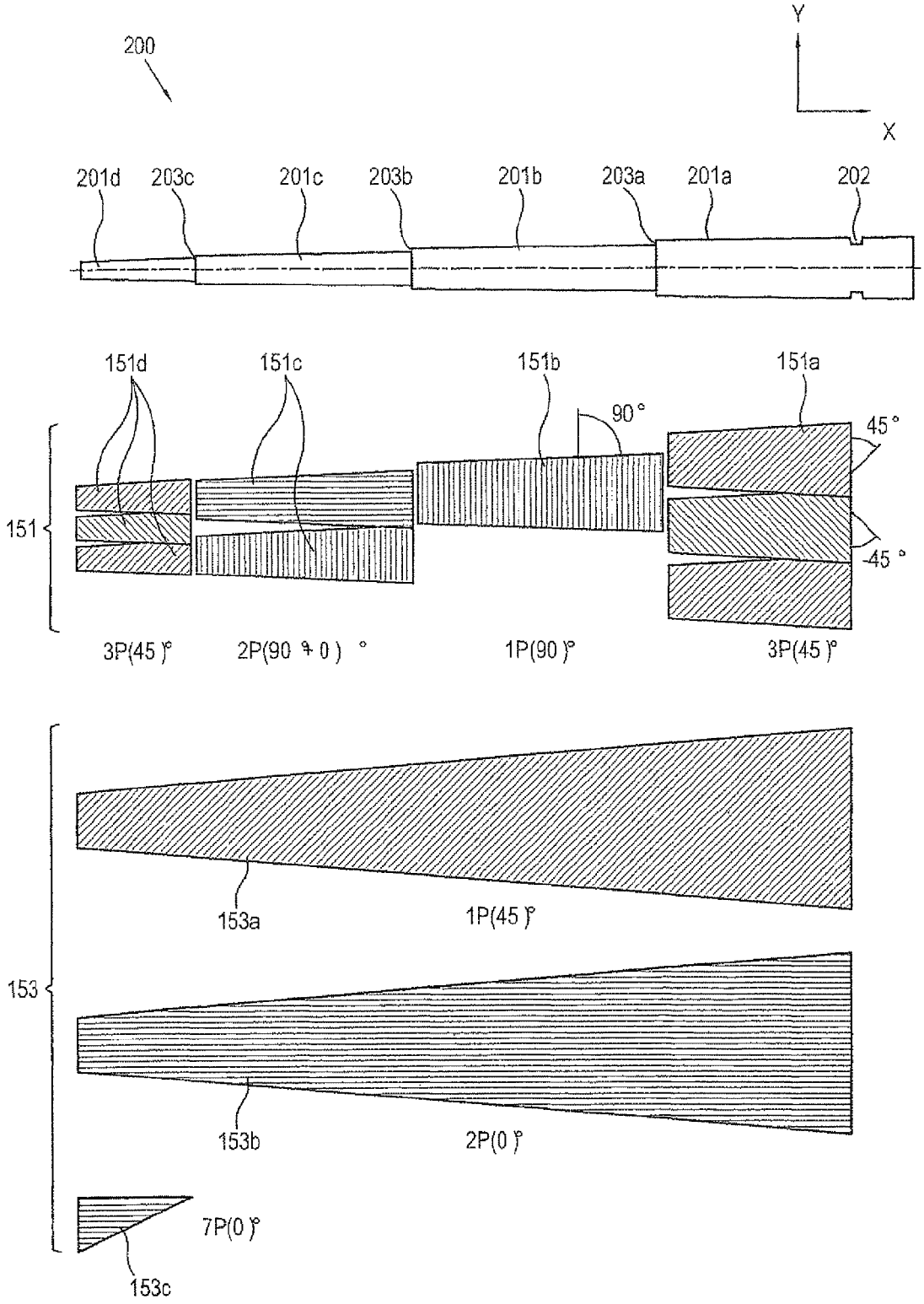
FIGS. 3 to 5 illustrate a manufacturing process of a club shaft in FIG. 1 according to a first exemplary embodiment of the present invention.

The graphite club shaft 120 is manufactured by a mold shaped like a round bar and called a mandrel 200 (note FIG. 3). The mandrel 200 according to the present invention includes mandrel joint units 203*a-c* which is formed with mandrel steps as shown in FIG. 3.

The grip unit 121 is provided on an upper end of the club shaft 120 so that a user may grab the club shaft 120. The grip unit 121 may be coupled with a grip 123 including various materials so that it is not slippery and a user may easily grab the club shaft 120. The grip unit 121 has a larger circumference or diameter than the coupling unit 125.

The coupling unit 125 is provided on a lower end of the club shaft 120 and is coupled with the club head 140. The coupling unit 125 has a smaller circumference or diameter than the grip unit 121.

The main body unit 131 connects the grip unit 121 and the coupling unit 125. The main body unit 131 includes joint units 133*a-c*. The main body unit 131 is divided by the joint units 133*a-c* formed with steps 135 drastically decreasing in circumference or external diameter.

Here, a first main body unit 131*a*, a second main body unit 131*b*, a third main body unit 131*c* and a fourth main body unit 131*d* may collectively be referred to as the main body unit 131 or represented by the reference numeral 131 in drawings (note again FIG. 1). The reference numerals 133*a*, 133*b* and 133*c* form the joint units and may collectively be referred to as the joint units 133 or represented by the reference numerals 133*a-c* in the drawings. The reference numerals for the mandrel 200, a lower sheet layer 151 or an upper sheet layer 153 may be represented by the same method as described above.

The joint units 133*a-c* are areas where the circumference or diameter of the main body unit 131 changes by decreasing in diameter from the grip unit 121 to the coupling unit 125 and a step is formed at each joint unit. As shown in FIG. 2, the three joint units 133*a-c* are provided, but the invention is not limited specifically to three joint units. Alternatively, single, two or four or more joint units 133 may be provided.

As shown in FIG. 2, each joint unit 133 may have a single step 135 as the first joint unit 133*a* which is adjacent to the grip unit 121. The second joint unit 133*b* and the third joint units 133*c*, other than the first joint unit 133*a*, may have two steps 136*a* and 136*b*. The number of the steps 135 and 136 may vary with each of the joint units 133*a*, 133*b* and 133*c*.

Here, the steps 135 and 136 of the joint units 133 are shaped like steps, but may otherwise have various shapes including a shape inclined at a predetermined angle or a round shape.

The main body unit 131 is divided by the joint units 133 and includes the first main body unit 131*a* which is disposed between the grip unit 121 and the first joint unit 133*a*. The second main body unit 131*b* which is disposed between the first joint unit 133*a* and the second joint unit 133*b* and the third main body unit 131*c* is disposed between the second joint unit 133*b* and the third joint unit 133*c*.

The coupling unit 125 and the main body unit 131 are formed as the lower sheet layer 151 and the upper sheet layer 153, which are shaped like a film, are wound on the mandrel 200 and then sequentially laminated on the mandrel 200.

The function of the main body unit 131 which is divided by the joint unit 135 may vary by the shape and quantity of the steps 135, 136*a* and 136*b*, the thickness of the sheet layers 151 and 153, the direction of laminated fibers and the number of plies or materials of the sheet layers 151 and 153 or the type of the golf club 100 such as a driver, an iron, etc. In some cases, the function of the main body unit 131 may not be apparently distinguishable and multi functions may be performed simultaneously.

For example, the first main body unit 131*a* provides stable feeling upon the striking of a golf ball, the second main body unit 131*b* improves flight distance, the third main body unit 1310 provides uniform swing or speed and the fourth main body unit 131*d* enhances striking power and feel.

Here, a combination of materials including carbon film which has a proper characteristic for the function of each joint unit 133 or the main body unit 131 may maximize the functions thereof.

That is, the joint unit 133 and the main body unit 131 may provide following effects.

Imbalance of power and shock which arises from the weight of the club head 140, etc. during the striking of the golf ball with the golf club 100 is transmitted to a user or the golf ball. Also, imbalance of power and shock which arises out of the swing accelerates and is transmitted to a user. Further, the shock which is generated by the striking of the golf ball on the swing path is transmitted to a user through the golf club 100.

The swing speed which is generated from a user's movement during a swing may become more uniform by the club shaft 120 to be transmitted to the club head 140. Thus, the swing speed which is fast or slow depending on a player may become uniform so that a player can perform a stable swing. That is, a user may make a consistent shot and maintain consistent striking direction.

Also, a user may be given good feeling at the moment of striking the golf ball during the swing, and make a stable and pleasant shot.

As each joint unit 133 is bent by a user's swing, the contact time of the golf ball and the club head 140 increases and the flight distance of the golf ball may improve. A striking power (kick) to the golf ball may be increased by the joint unit 133 and the steps 135 and 136*a-b* to improve the flight distance.

According to the present invention, the joint units 133*a-c* act like a joint of the human body and absorbs shock to make a stable swing speed and enhance power.

Shock or imbalance of power which arises out of the swing may be effectively absorbed by the joint units 133. That is, each joint unit 133 may absorb shock step by step and maintain a stable swing path.

With the foregoing configuration, a manufacturing process of the golf club 100 according to the first exemplary embodiment of the present invention will be described with reference to FIGS. 3 to 5.

In order to manufacture the golf club shaft a mandrel 200 is provided as shown in FIG. 3. The mandrel 200 includes mandrel joint units 203 which includes mandrel steps 203*a*—c that decrease in circumference and diameter from one end of the mandrel to the other end. The mandrel main body unit is divided into several parts with mandrel joint units 203*a-c* there between. That is, a first mandrel main body unit 201*a* is provided at the top or first end of the mandrel 200 along an axis X. A second mandrel main body unit 201*b* is disposed between a first mandrel joint unit 203*a* and a second mandrel joint unit 203*b*. A third mandrel main body unit 201*c* is disposed between the second mandrel joint unit 203*b* and the third mandrel joint unit 203*c*. Finally, a fourth mandrel main body unit 201*d* is disposed between the third mandrel joint unit 203*c* and the second end of the mandrel body. Further, a mandrel groove 202 is provided on a top or first end of the first mandrel main body unit 201*a* and is axially separated from sheet layers 151 and 153 to be applied to the forming mandrel, or to be delivered or fixed upon the mandrel.

The mandrel joint unit 203 is shaped in consideration of the thickness of the club shaft 120 to be manufactured and the compression and deformation rate of the sheet layers 151 and 153 so as to maintain the shape of the joint units 133*a-c*.

During manufacture an anti-blocking agent is applied to a surface of the mandrel 200 and the lower sheet layer 151 contacts and overlaps the mandrel 200. During this process, the lower sheet layer 151 is cut correspondingly to the size of each of the mandrel main body units 201*a*, 201*b*, 201*c* and 201*d*. That is, the lower sheet layer 151 includes a first lower sheet layer 151*a* corresponding to the first mandrel main body unit 201*a*, a second lower sheet layer 151*b* corresponding to the second mandrel main body unit 201*b*, a third lower sheet layer 151*c* corresponding to the third mandrel main body unit 201*c* and a fourth lower sheet layer 151*d* corresponding to the fourth mandrel main body unit 201*d*.

Here, the direction of the laminated fibers of one of the lower sheet layers 151 is different from the direction of fibers laminated in a neighboring lower sheet layer 151.

That is, referring to FIG. 3, the direction of fibers of the first lower sheet layer 151*a* is 45 degrees (strictly speaking, ±45 degrees formed by the axis X and the fibers, +45 degrees if right fibers go up in the direction of 45 degrees on the basis of the axis X and −45 degrees if right fibers go down in the direction of 45 degrees on the basis of the axis X, which is the same hereinafter). Meanwhile, the direction of fibers of the second lower sheet layer 151 is 90 degrees. The direction of fibers of the third lower sheet layer 151 is 90 degrees and zero degree. The direction of fibers of the fourth lower sheet layer 151*d* is ±45 degrees.

The foregoing description defines one exemplary embodiment, and the arrangement of the direction of fibers of the lower sheet layer 151 is not limited thereto.

The number of plies which are laminated in one of the lower sheet layer 151 is different from that of plies of the neighboring lower sheet layer 151.

That is, referring to FIG. 3, the number of plies of the first lower sheet layer 151*a* is three plies, the second lower sheet layer 151*b* one ply, the third lower sheet layer 151*c* two plies and the fourth lower sheet layer 151*d* three plies.

The foregoing description defines one exemplary embodiment, and the arrangement of the number of plies of the lower sheet layer 151 is not limited to this specific embodiment.

Variation in the direction of fibers and the number of plies laminated in the lower sheet layer 151 may help the respective main body units 131 perform desired functions. For example, the second lower sheet layer 151*b* has one ply and the direction of fibers is 90 degrees. Thus, the second lower sheet layer 151*b* will bend better than other lower sheet layers 151*a*, 151*c* and 151*d*Accordingly, a user may improve the flight distance with the excellent restoration force of the club head 140 while striking the golf ball with the golf club 100.

Figure 4:
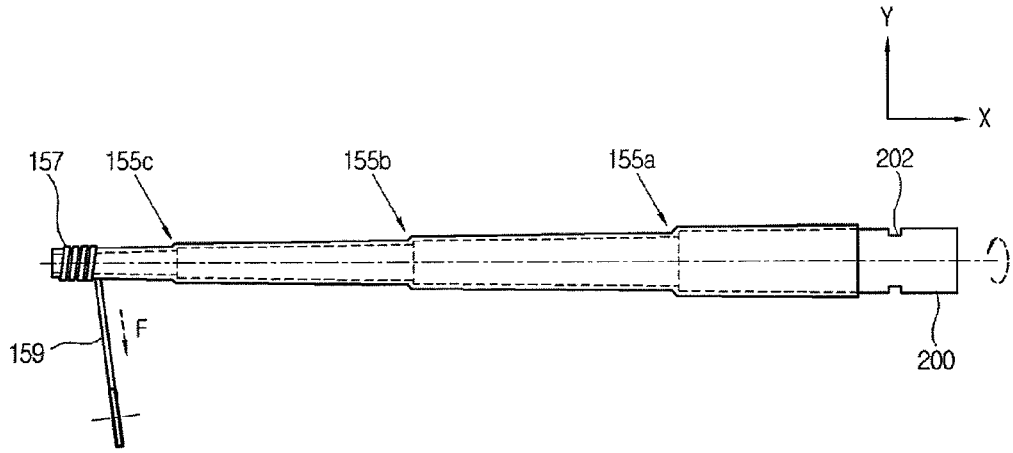
Figure 5:
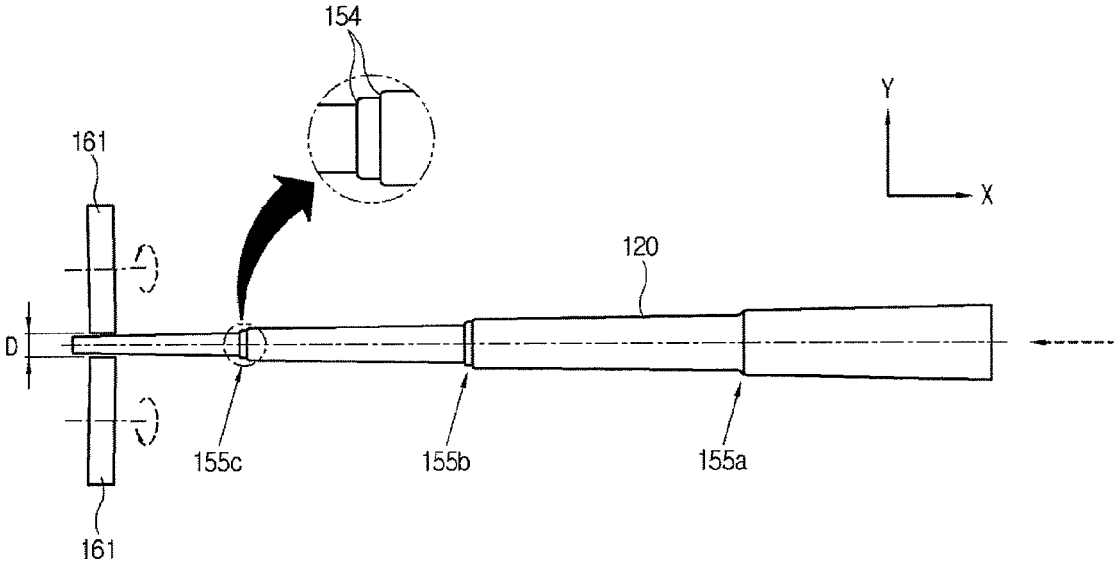

As shown in FIG. 4, the upper sheet layer 153 is laminated onto the lower sheet layer 151. The first upper sheet layer 153*a*, which has one ply and has a direction of fibers of +45 degrees, is laminated onto the lower sheet layer 151, and then a second upper sheet layer 153*b* which has two plies and has a direction of fibers of zero degree is laminated onto the first upper sheet layer 153*a*. A third upper sheet layer 153 which has seven plies and has the direction of fibers of zero degree is then laminated in a position corresponding to the fourth mandrel main body unit 201*d*.

The torsional load which is generated by striking a golf ball with the club head 140 may be sufficiently supported by the third upper sheet layer 153*c* which has seven plies and has the direction of fibers of zero degrees.

Here, the number of plies and the direction of laminated fibers of the upper sheet layer 153 are described for one exemplary embodiment and the present invention is not limited thereto. The first, second and third upper sheet layers 153*a*, 153*b* and 153*c* are described above for the upper sheet layer 153, but additional sheet layers may be laminated in any position, in various plies and various directions of fibers.

The sheet layers 151 and 153 are laminated by being compressed to the mandrel 200.

As shown in FIG. 4, one end of the sheet layers 151 and 153 are taped by a tape 159 to form a taping layer 157 the force F of pulling the tape 159 during the taping process (refer to FIG. 4) is 3.5 to 5.5 kg/cm$^2$, and preferably within the range of 4.5 kg/cm$^2$±20%. For example, if too small a force is applied to the tape 159, the sheet layers 151 and 153 do not contact effectively on the mandrel joint unit 203 as the mandrel joint unit 203 is formed on the mandrel 200. If too little force is applied it is hard to form the sheet joint unit 155 corresponding to the shape of the mandrel joint unit 203. On the other hand, if too great a force is applied to the tape 159, the lower sheet layer 151 or the upper sheet layer 153 can be pushed along the axis X in the moving direction of the taping.

If the force F which is applied to the tape 159 while forming the taping layer 157 is maintained within a predetermined range, the sheet layers 151 and 153 effectively conform to the shape of the mandrel joint unit 203. That is, the sheet joint unit 155 which includes a sheet step 154 corresponding to the mandrel step is formed effectively. Finally, the joint unit 133 which has a step 135 may be formed in the external part of the club shaft 120.

The mandrel 200 is separated from the sheet layers 151 and 153 after the process in FIG. 4 and then subject to thermal treatment (not shown).

Then, the external diameter of the club shaft 120 is ground. A centerless grinder is used for the grinding process. That is, while the club shaft 120 is moved to the left along the direction X, the centerless grinder 161 grinds the external diameter to a predetermined thickness. Here, an interval D of the centerless grinder 161 may be automatically adjusted in consideration of the moving speed and the step 135 of the club shaft 120. The external diameter of the club shaft 120 is ground to a predetermined thickness to achieve a uniform and stable quality. Next the club shaft 120 is ground, balanced and the number of vibrations of the club shaft 120 is inspected in order to determine if the shaft is within a predetermined desirable range. The inspected club shaft 120 is then cut to a length which is proper for each golf club 100.

Finally, the cut club shaft 120 is painted. After the painting process is completed, the club shaft 120 is coupled with the grip 123 and the club head 140. Thus, a golf club 100 is finished, and a final test including the swing weight is conducted for the golf club 100.

The foregoing processes steps may be changed in order if necessary or desirable.

Second Exemplary Embodiment

Figure 6:
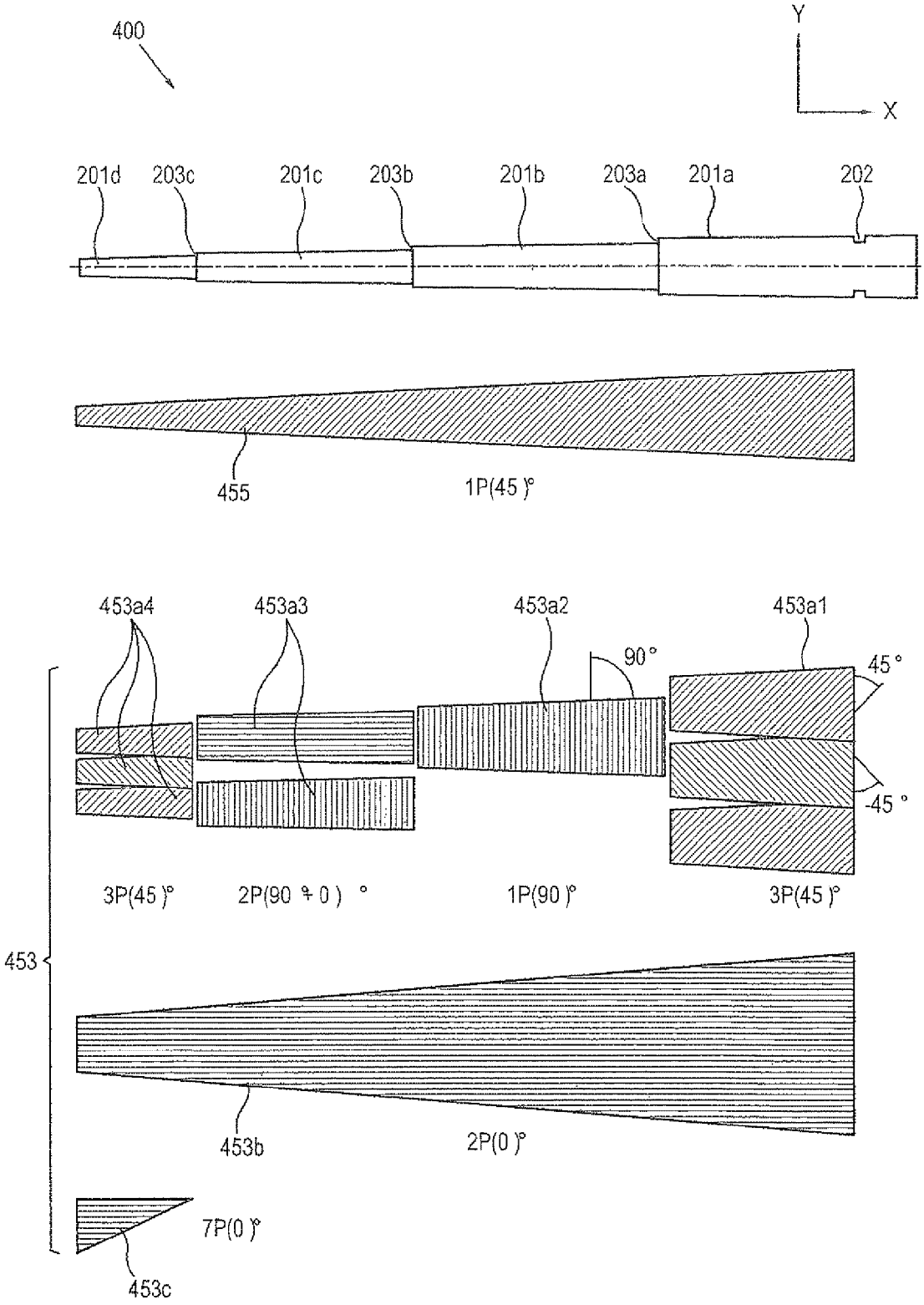
FIG. 6 illustrates a manufacturing process of a club shaft in FIG. 1 according to a second exemplary embodiment of the present invention.

As shown in FIG. 6, a golf club 400 according to the second exemplary embodiment of the present invention is different from the golf club 100 according to the first exemplary embodiment in that a lower sheet layer 455 which has one ply and has the direction of fibers of 45 degrees is wound on a mandrel 200. Then, cut segments comprising a first upper sheet layer 453*a*, a second upper sheet layer 453*b* and a third upper sheet layer 453*c* are sequentially laminated.

The arrangement and the work process of the first upper sheet layer 453*a* is the same as that of the lower sheet layer 151 according to the first exemplary embodiment. Thus, further detailed description will be omitted and the prior description is incorporated by reference. That is, the first upper sheet layer 453*a* includes a first upper sheet layer 453*a*1 as a first layer, a second upper sheet layer 453*a*2 as a second layer, a first upper sheet layer 453*a*3 as a third layer and a first upper sheet layer 453*a*4 as a fourth layer.

The upper sheet layer 453 may further include at least one sheet layer other than the first upper sheet layer 453*a*, the second upper sheet layer 453*b* and the third upper sheet layer 453*c*. The laminating order of the first, second and third upper sheet layers 453*a*, 453*b* and 453*c* according to the second exemplary embodiment may be changed as necessary.

What is not specifically described for the golf club 400 according to the second exemplary embodiment is the same as the description of the golf club 100 according to the first exemplary embodiment.

As described above, the present invention provides a golf club which stabilizes a swing speed.

Also, the present invention provides a golf club which improves striking feel.

Further, the present invention provides a golf club which secures improved fight distance.

Further, the present invention provides a golf club which excels in absorbing shock.

Further, the present invention provides a golf club with uniform quality.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A graphite golf club shaft which is formed on a mandrel, the graphite golf club shaft comprising:

a coupling unit suitable to be coupled with a club head designed to strike a golf ball and a main body unit extending from the coupling unit, the golf club shaft being formed upon a mandrel with a generally cylindrical configuration having mandrel joint segments which are formed as mandrel steps that decrease in diameter from one end of the mandrel to the other end of the mandrel, the golf club shaft main body unit includes a lower sheet layer having embedded fibers, said lower sheet layer contacting and overlapping the mandrel and an upper sheet layer overlapping the lower sheet layer, at least the lower sheet layer being cut in segments and forming sheet joint units which conform with sheet steps decreasing in diameter corresponding to the mandrel steps, the direction of fibers of at least the lower sheet layers being cut such that lower sheet joint units have a different direction of fibers with respect to neighboring lower sheet joint units, and at least one of the lower sheet joint units being formed in segments where the direction of fibers sequentially crosses at 45 degrees and another one of the lower sheet units has fibers where the direction of the fibers is 90 degrees with respect to the longitudinal axis of the golf club shaft.

2. The graphite golf club according to claim 1, and further comprising a taping layer which is taped with a tape from an external part of the upper sheet layer, wherein the tape is taped to an upper part of the upper sheet layer with a tension of 3.5 kg/cm$^2$ to 5.5 kg/cm$^2$.

3. The graphite golf club according to claim 2, wherein an external diameter is ground by a centerless grinder.

* * * * *